United States Patent [19]

Kaneko et al.

[11] Patent Number: 4,698,467

[45] Date of Patent: Oct. 6, 1987

[54] ELECTRODES OF VACUUM SWITCH

[75] Inventors: Eiji Kaneko, Yokohama; Satoru Yanabu, Machida; Tohoru Tamagawa, Chigasaki, all of Japan

[73] Assignee: Kabushiki Kaisha Toshiba, Kawasaki, Japan

[21] Appl. No.: 791,129

[22] Filed: Oct. 24, 1985

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 4,430,536 | 2/1984 | Kurosawa et al. | 200/144 B |
| 4,471,184 | 9/1984 | Sanu et al. | 200/144 B |
| 4,508,945 | 2/1985 | Zuckler | 200/144 B |
| 4,513,186 | 4/1985 | Thomas | 200/144 B |
| 4,584,445 | 4/1986 | Kashiwagi et al. | 200/144 B |

FOREIGN PATENT DOCUMENTS

| | | | |
|---|---|---|---|
| 57-23430 | 2/1982 | Japan | 200/144 B |
| 58-73929 | 5/1983 | Japan | 200/144 B |

*Primary Examiner*—Robert S. Macon

*Attorney, Agent, or Firm*—Schwartz, Jeffery, Schwaab, Mack, Blumenthal & Evans

[57] ABSTRACT

An electrode structure disposed in a vacuum switch generally comprises a pair of relatively separable electrodes and a pair of contacts provided on the opposing surfaces of the electrodes and surface areas of the contacts are selected to be smaller than the surface areas of the electrodes. The vapor pressure $P_0$ and specific resistance $\rho_0$ of the electrode material and the vapor pressure $P_1$ and specific resistance $\rho_1$ of the contact material are held in a relation $$\frac{P_0}{\rho_0} > \frac{P_1}{\rho_1}$$

and values representing specific heat, heat of fusion and heat of evaporation of the contact material are 100±20% of those of the electrode material except a portion on which the contact material is provided.

3 Claims, 3 Drawing Figures

ELECTRODES OF VACUUM SWITCH

BACKGROUND OF THE INVENTION

This invention relates to a novel structure of electrodes of a vacuum switch of the type in which an axial magnetic field is generated.

As is well known in the art, a vacuum switch generally comprises a pair of electrodes disposed in the vacuum switch to be relatively movable to interrupt current passing. With the vacuum switch it is difficult to provide the electrodes in a mutually slidable manner in the vacuum condition, so that the electrodes are ordinarily held in an abutting relation. However, electrodes held in contact condition in the vacuum tend to be fused together particularly when the vacuum switch is thrown into ON state due to the arc created at that time or by a heavy current flowing between the electrodes. In order to prevent such adverse mutual fusion of the electrodes, contacts made of a metal having a fusion preventing property or a copper alloy containing various additives have been provided on the contacting surfaces of the electrodes. Ordinarily, the metal and additives are selected from those having vapor pressures higher than that of copper at the same temperature condition. As is well known in the art, the arc created in a vacuum switch at the time of interruption is sustained by the vapor of metals forming the electrodes. Thus, in case of a vacuum switch wherein arc is stabilized by the application of an axial i.e. longitudinal magnetic field, if an uneven distribution exists in the material forming the electrodes, the arc created between the electrodes tends to be concentrated into the unevenly distributed portion of the material. Furthermore, the alloy containing additives tends to create metallurgical defects, which in turn deteriorate the dielectric strength and reduce the interruption capability of the vacuum switch.

For this reason, it is preferable to reduce the surface area of the contacts to have the smallest possible value. However, an excessive reduction of the surface area is liable to concentrate the arc into limited portions A of the contacts 1 and 2 as shown in FIG. 1, thus heating and/or melting the portions A and reducing the interruption capability of the vacuum switch.

In order to avoid the above described difficulty, an alternative construction as shown in FIG. 2 may be considered, in which the contacting areas of the contacts 1 and 2 are increased so as to cover the entire surfaces of the electrodes 3 and 4, respectively. In this case, although a wide distribution of arc and an increased interruption capability of the vacuum switch may be expected, the deterioration of the dielectric strength due to the defects of the contact material becomes intolerably large.

Conversely, when a material having a vapor pressure lower than that of copper is used for the contacts, the arc is concentrated to a portion of the electrodes other than the contacts, thus deteriorating the current interrupting capability of the vacuum switch.

SUMMARY OF THE INVENTION

A primary object of this invention is to provide electrodes of a vacuum switch capable of interrupting a heavy current at a high voltage.

Another object of this invention is to provide electrodes of a vacuum switch, wherein metallurgical defects tending to occur in the contacts can be substantially eliminated, and the concentration of the arc and the deterioration of the dielectric strength of the vacuum switch can be substantially reduced.

Still another object of this invention is to provide electrodes of a vacuum switch wherein concentration of the arc can be substantially reduced and the current interrupting capability of the vacuum switch can be substantially improved.

These and other objects of this invention can be achieved by electrode structure of a vacuum switch according to this invention which comprises a pair of electrodes to be axially relatively separable in the vacuum switch vessel and a pair of contacts provided on the opposing surfaces of the electrodes, respectively, and each having a diameter smaller than that of the electrode, the electrodes and the contacts being constituted by materials satisfying a relation:

$$\frac{P_0}{\rho_0} > \frac{P_1}{\rho_1}$$

where $P_0$ and $\rho_0$ represent a vapor pressure and an electric resistance measured at a melting point of an electrode material used, and $P_1$ and $\rho_1$ represent a vapor pressure and an electric resistance measured at a melting point of a contact material used.

In addition, in a preferred embodiment of the invention, values representing the specific heat, heat of fusion, and heat of evaporation of the material forming the contacts are 100±20 % of those of the material forming the electrodes.

DETAILED DESCRIPTION OF THE INVENTION

The invention will now be described in detail with reference to the accompanying drawings.

In experiments to obtain the relationship between electrode materials and contact materials with respect to characteristics of an arc in the vacuum condition of a vacuum switch in which an axial magnetic field is applied to stabilize the arc and the diameter of the contact is selected to be smaller than that of the electrode, it was found that the arc in the vacuum condition is evenly distributed over the entire surface of the electrodes and sufficient interrupting ability is obtained in a case where the following relationship or equation exists between the electrode materials and the contact materials shown in Table 1.

$$\frac{P_0}{\rho_0} > \frac{P_1}{\rho_1} \quad (1)$$

wherein: $P_0$ represents vapor pressure [Pa] at the melting point of the material forming the electrodes, $P_1$ represents vapor pressure [Pa] at the melting point of the material forming the contacts, $\rho_0$ an electric specific resistance [Ωm] of the material forming the electrodes, and $\rho_1$ represents an electric specific resistance [Ωm] of the material forming the contacts.

TABLE 1

| material of electrodes | material of contacts |
|---|---|
| Cu | Cr or its alloy |
| Cu | Fe or its alloy |
| Fe | Cr or its alloy |
| Fe | Mn or its alloy |
| Cr | Cu or its alloy |
| Cr | Fe or its alloy |
| Be | Ag or its alloy |
| Be | Al or its alloy |

In addition, it was found that the properties such as specific heat, heat of fusion, and heat of evaporation of the material forming the electrodes must be substantially equalized to those of the material forming the contacts. More specifically, when the above described heat characteristics of the material forming the contacts are held within 100±20% of those of the material forming the electrodes, the arc can be distributed evenly over the entire operative surfaces of the electrodes.

Figure 1:
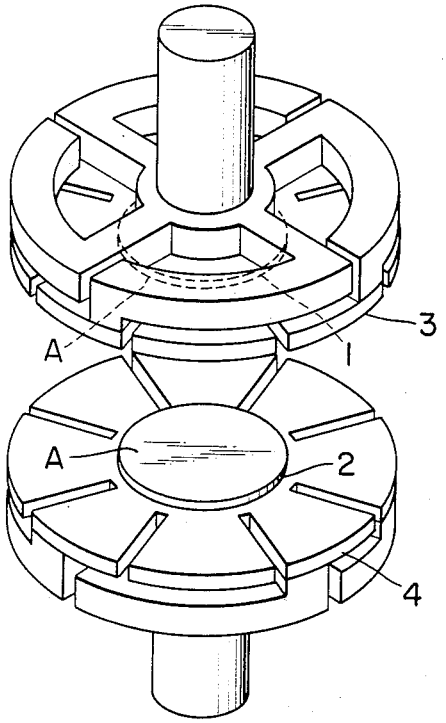
FIGS. 1 and 2 are perspective views showing electrodes of a conventional vacuum switch.
Figure 2:
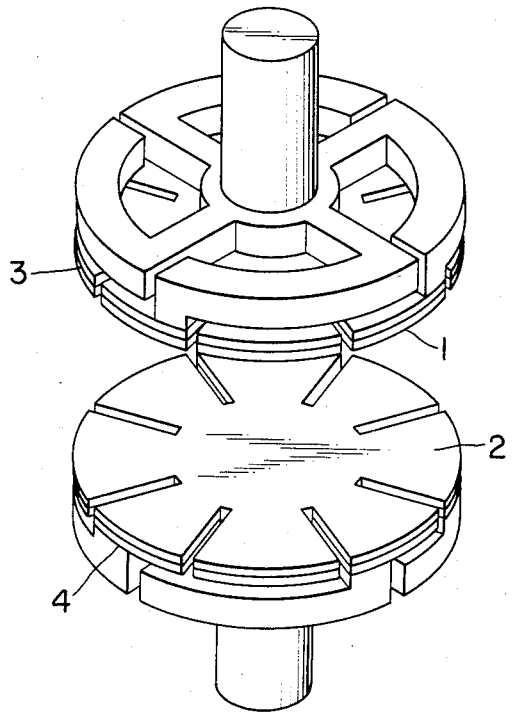
Figure 3:
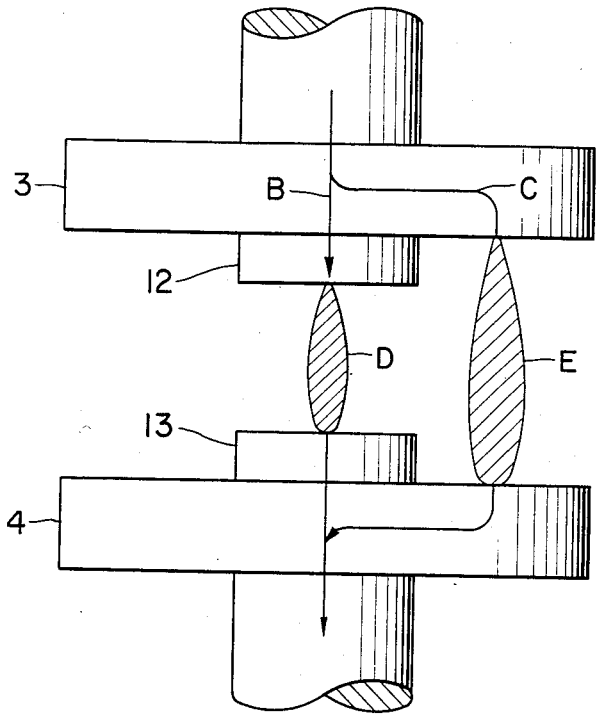
FIG. 3 is a diagram showing, in elevation, a preferred embodiment of this invention.

FIG. 3 illustrates a preferred embodiment of the invention, wherein coil portion is omitted for clarifying the drawing.

In FIG. 3, two typical current portions flowing across the electrodes are indicated by arrow lines B and C. One current portion indicated by the line B flows through the contacts 12 and 13 having a specific resistance $\rho_1$ and through arc D, while the other part of the current indicated by the line C flows through the electrode portions other than the contacts, having a specific resistance $\rho_0$, and through arc E. In this case, if the contacts 12 and 13 are made of a material having an excessively high vapor pressure, the most part of the metal vapor sustaining the arc is supplied from the contacts, and hence the arc is concentrated to the contacts 12 and 13. On the other hand, when the vapor pressure $P_0$ of the material forming the electrode portions is selected to be higher than the vapor pressure $P_1$ of the material forming the contacts, that is under the condition of $P_0 > P_1$, the metal vapor is further supplied from the electrode portions, and the arc is easily shifted from the contacts 12 and 13 to the electrode portions. In this case, however, if the vapor pressure $P_0$ is excessively higher than the vapor pressure $P_1$, the arc is concentrated to the electrode portions other than the contacts. For this reason, it is essential that the value of $P_0$ is restricted to be less than 10 times the value of $P_1$. Furthermore, since the magnitude of a current flowing through a material is inversely proportional to the specific resistance of the material, for the purpose of evenly distributing the arc, it is essential that the specific resistances $\rho_0$ and $\rho_1$ of the materials forming the electrode portions and the contacts are held in the following relation:

$$\frac{1}{\rho_0} > \frac{1}{\rho_1}$$

The above described two relations, that is, $P_0 > P_1$ and $$\frac{1}{\rho_0} > \frac{1}{\rho_1}$$

are combined into a single relation of $$\frac{P_0}{\rho_0} > \frac{P_1}{\rho_1}$$

which constitutes a condition for stabilizing the arc and improving the current interrupting property of the vacuum switch wherein an axial magnetic field is established and the surface area of the contacts is made smaller than that of the electrode portions.

In order to distribute the arc evenly and to improve the current interrupting property of the vacuum switch, it is not sufficient only to satisfy the above described relation. In a case where the arc created in the vacuum switch does not equally increase the temperatures of the electrode portions and the contacts, local heating of the materials tends to occur despite of the fulfillment of the relation, and an excessive amount of vapor tends to be supplied from the locally heated portion, thereby disturbing even distribution of the arc.

Principal factors determining a temperature-rise in the electrode and contact materials are specific heat, heat of fusion and heat of evaporation of the material. It has been found that equal temperature-rise of the electrode portions and the contacts can be achieved when the specific heat, heat of fusion and heat of evaporation of the material formed into the contacts are held within 100±20% of those values of the material formed into the electrode portions, and in this manner, the distribution and stability of arc, and hence the current interrupting property of the vacuum switch can be substantially improved.

In further experiment performed by using Cu as shown in Table 1 as a typical example of the electrode material among various combinations of the materials forming the electrode portions and the contacts, Cu-Cr, Cu-CuCr, Cu-Fe, Cu-CuW, Cu-CuBe alloy, and Cu-WC satisfy the relation $$\frac{P_0}{\rho_0} > \frac{P_1}{\rho_1},$$

as shown in Table 2.

TABLE 2

| material of electrodes | material of contacts | $\frac{P_0}{\rho_0} > \frac{P_1}{\rho_1}$ | heat properties ±20% | distribution of arc |
|---|---|---|---|---|
| Cu | Cr | yes | yes | satisfactory |
| Cu | CuCr Alloy (25%-50%) | yes | yes | satisfactory |
| Cu | Fe | yes | yes | satisfactory |
| Cu | Cuw | yes | no | unsatisfactory |
| Cu | AgWC | no | no | unsatisfactory |
| Cu | CuTe Alloy | no | yes | unsatisfactory |
| Cu | CuBe Alloy | yes | no | unsatisfactory |
| Cu | WC | yes | no | unsatisfactory |

Furthermore, among these combinations of the materials satisfying the relation $$\frac{P_0}{\rho_0} > \frac{P_1}{\rho_1},$$

it is also found in Table 2 that the combinations Cu-Cr, Cu-CuCr and Cu-Fe exhibit satisfactory distribution of arc, and from Table 3, it is made clear that in all of these three combinations, the heat properties are satisfying the relation of 100±20% of those of the electrode forming material, i.e. Cu in the example performed by the experiments, and the values in Table 3 is represented by relative values with respect to those of Cu.

TABLE 3

| contact material | specific heat | heat of evaporation | heat of fusion |
|---|---|---|---|
| Cu | 1.00 | 1.00 | 1.00 |
| Cr | 1.09 | 1.14 | 1.13 |
| CuCr Alloy | ≈1.09 | ≈1.11 | ≈0.97 |
| Fe | ≈1.20 | 1.17 | 1.17 |
| CuW | 0.43 | — | — |
| WC | ≈0.33 | — | — |
| CuBe Alloy | ≈1.65-2.17 | 0.97 | 0.84 |

As described hereinabove, according to this invention, evenly distributed arc condition can be obtained and an improved interrupting capability can be attained by constituting the electrodes and contacts with materials selected so as to have specific relationships in their properties therebetween. In the foregoing description with reference to the experiments as shown in Tables, copper is referred to as a preferred material for the electrodes as one typical example, but other materials such as shown in Table 1 can be also used as electrode material for the vacuum switch in combination with the preferred material as contacts.

What is claimed is:

1. An electrode structure disposed in a vacuum switch vessel comprising: a pair of electrodes disposed to be separable from each other in the vacuum switch vessel, and a pair of contacts fixed on opposing surfaces of said electrodes, respectively, each of said contacts having a diameter smaller than that of the correspondingly fixed electrode, said electrode material comprising copper and said contact material comprising a copper-chromium alloy comprising between about 25 and about 50% chromium, wherein both said electrode and contact materials satisfy a relation:

$$\frac{P_0}{\rho_0} > \frac{P_1}{\rho_1}$$

where $P_0$ and $\rho_0$ represent vapor pressure and electric resistance at a melting temperature of the material of the electrodes, and $P_1$ and $\rho_1$ represent vapor pressure and electric resistance at a melting temperature of the material of the contacts, the material of the contacts possessing values representing specific heat, heat of fusion and heat of evaporation which are 100±20% with respect to values representing specific heat, heat of fusion and heat of evaporation of the material of the portion of said electrode other than that portion to which said contacts are fixed.

2. The electrode structure according to claim 1 wherein said vapor pressure $P_0$ is within ten times of said vapor pressure $P_1$.

3. The electrode structure according to claim 1, wherein the material of said electrode consists essentially of copper and the material of said contact consists essentially of a copper-chromium alloy containing between about 25 and about 50% chromium.

* * * * *